United States Patent [19]

Fritz

[11] 4,046,680

[45] Sept. 6, 1977

[54] PERMANENT MAGNET HIGH INTENSITY SEPARATOR

[75] Inventor: Alan J. Fritz, Grand Rapids, Minn.

[73] Assignee: Itasca Magnetics, Inc., Minneapolis, Minn.

[21] Appl. No.: 653,366

[22] Filed: Jan. 29, 1976

Related U.S. Application Data

[63] Continuation-in-part of Ser. No. 558,337, Oct. 17, 1975, Pat. No. 3,947,349.

[51] Int. Cl.[2] ..... B03C 1/14

[52] U.S. Cl. ..... 209/214; 209/223 A; 209/225

[58] Field of Search ..... 209/38, 39, 213, 214, 209/223 R, 223 A, 222, 225, 228, 232, 217; 210/222, 402, 404

[56] References Cited

U.S. PATENT DOCUMENTS

| | | | |
|---|---|---|---|
| 3,409,139 | 11/1968 | Jackson et al. | 210/404 |
| 3,487,941 | 1/1970 | Haapamaki | 210/404 |
| 3,947,349 | 3/1976 | Fritz | 209/214 |

*Primary Examiner*—Frank W. Lutter
*Assistant Examiner*—Ralph J. Hill
*Attorney, Agent, or Firm*—Merchant, Gould, Smith, Edell, Welter & Schmidt

[57] ABSTRACT

A magnetic separator in which the substance to be treated is passed in one direction through a body of foraminous, magnetically susceptible material of significant extent, while traversing in another direction a magnetic field extending in still another direction, the directions being substantially orthogonal. Vibration is applied to the body, preferably linear and preferably in generally the direction of the field. The field opposes the passage of magnetic particles though the body while the vibrator promotes the passage of non-magnetic particles, so that they emerge from the body at different locations for separate collection. The body is conveniently a hollow cylinder built up of sections of magnetic stainless steel screening folded and shaped, and the movement of the body is preferably rotation, the substance being applied to an outer cylindrical surface of the body and emerging from an inner, concentric cylindrical surface. A structure comprising a plurality of such hollow cylinders spaced axially along a hollow drum is shown, with means for feeding the substance individually to the several cylinders: the cylinders pass between fixed magnets during a portion of their rotation. The substance to be fed may be dry or in a slurry: when the slurry is used, certain modifications of the apparatus are desirable to improve its efficiency, and are also disclosed.

8 Claims, 13 Drawing Figures

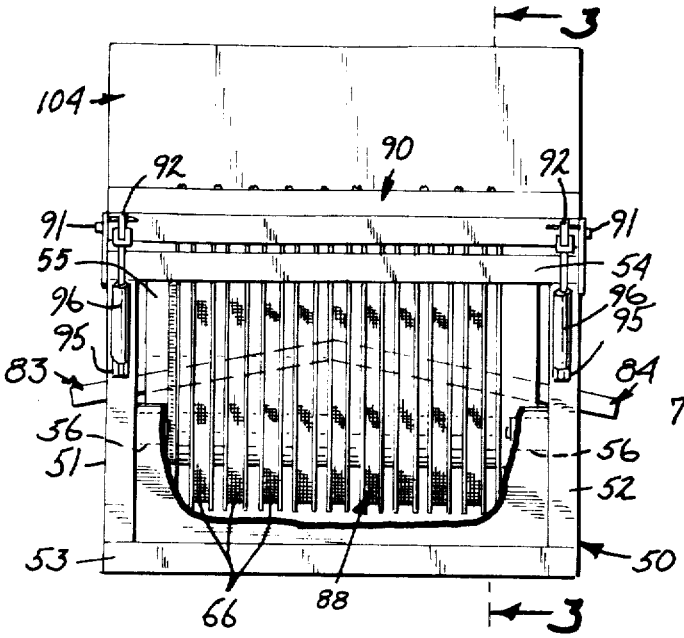
FIG. 2
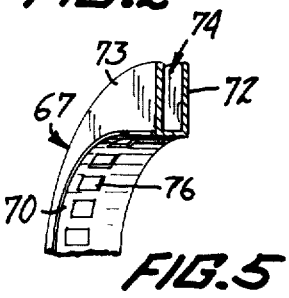
FIG. 5
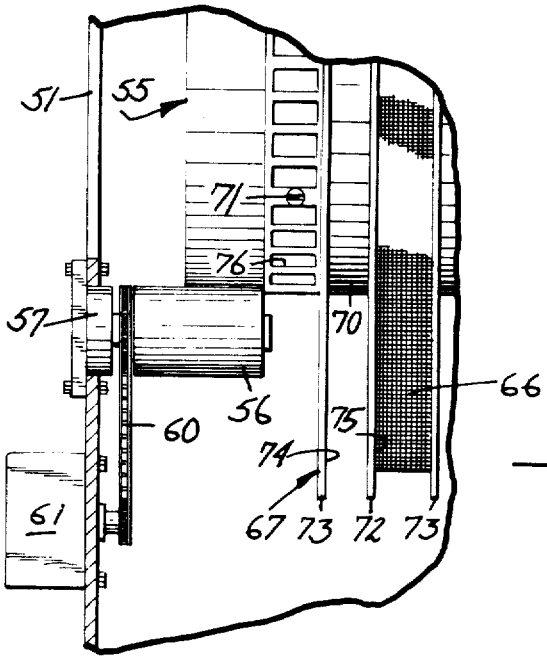
FIG. 4
FIG. 6
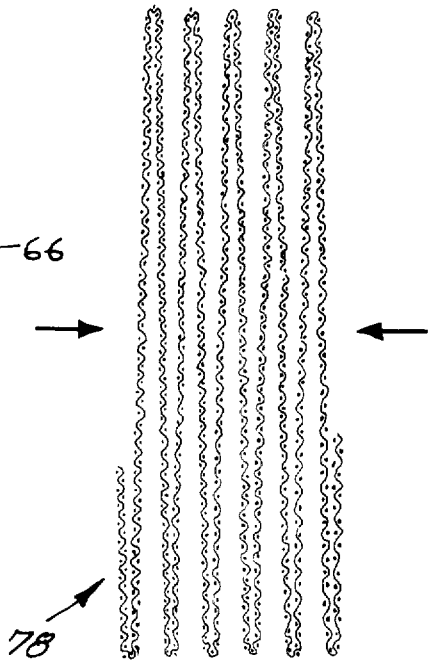

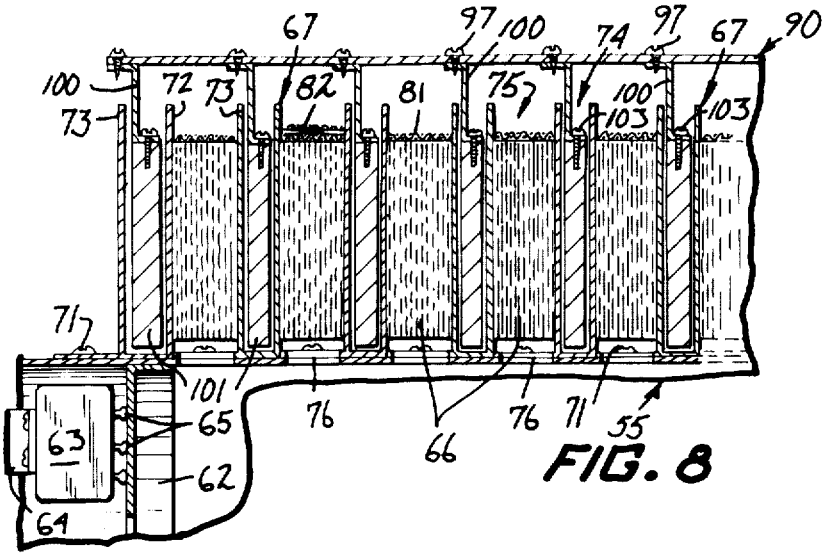
FIG. 8
FIG. 9
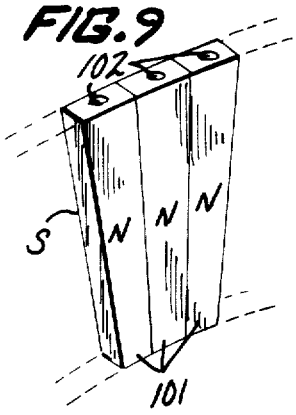
FIG. 10
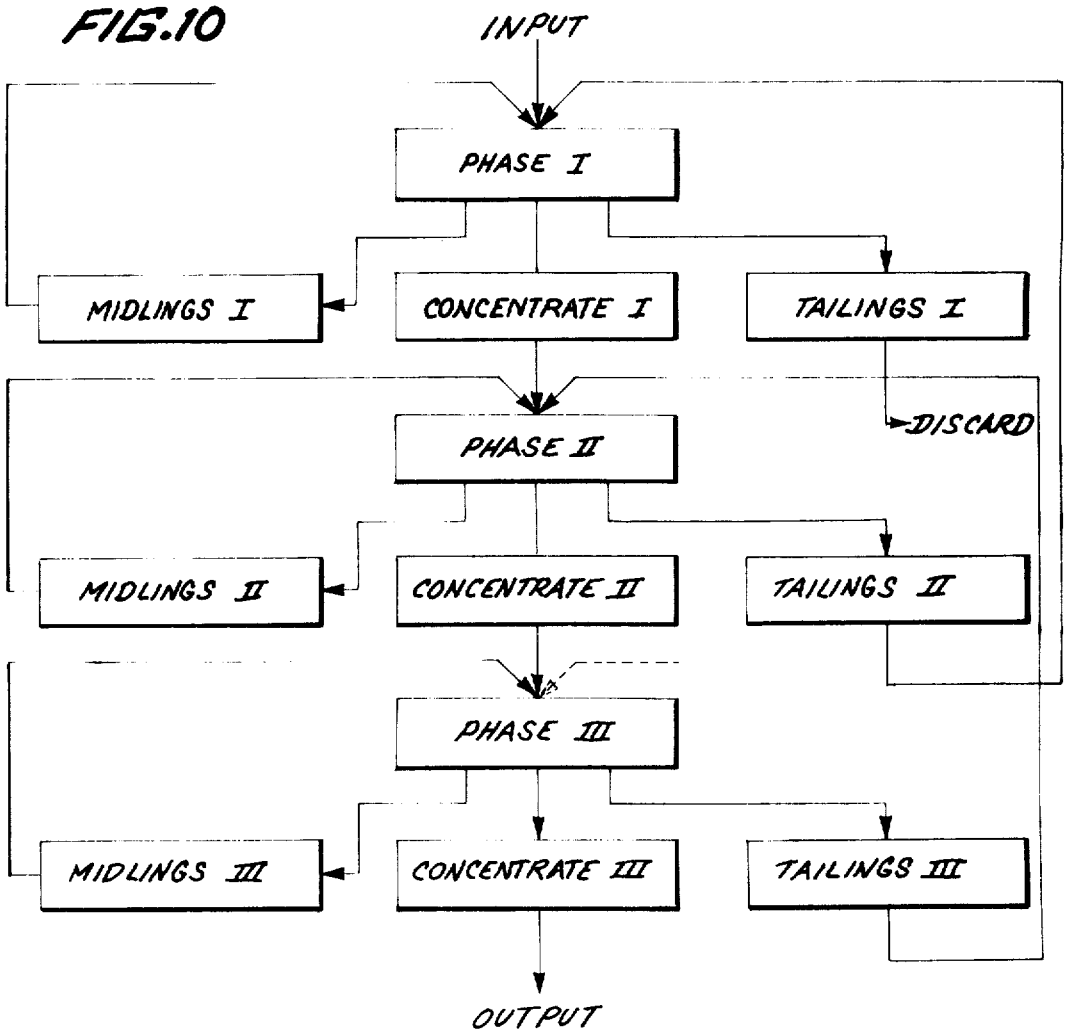

PERMANENT MAGNET HIGH INTENSITY SEPARATOR

This application is a continuation-in-part of my copending application, Ser. No. 558,337, now U.S. Pat. No. 3,947,349., filed Oct. 17, 1975, issued Mar. 30, 1976, and assigned to the assignee of the present application.

BACKGROUND OF THE INVENTION

This invention relates to the field of assorting apparatus, and particularly to apparatus for separating weakly magnetic particles from the non-magnetic particles of a mixture of the two. Here the word "magnetic" refers to particles which are magnetically susceptible, and is not meant to imply particles which are themselves permanently magnetized. The procedure is very important in modern iron mining operations, where the ore is of relatively low grade and contains much gangue. An example is the operation of taconite mining where the ores are of relatively low grade, contain primarily weakly magnetic iron minerals, and are commonly referred to as "oxidized taconite". Such ores are generally no better than the discarded "tailings" of earlier iron mining operations, and indeed those tailings may become a valuable source of iron by the use of my new separator.

Assorting of solids according to their magnetic properties is not new, and devices are known to perform this function, both with particles in the dry state and with particles in the form of a slurry. Such devices have heretofore had the defect that for successful operation on weakly magnetic materials, it has been necessary to use electromagnetics of tremendous size which required complicated auxiliary cooling facilities and consumed many kilowatt hours of electricity per ton of treated material.

SUMMARY OF THE INVENTION

I have discovered that much more satisfactory volumetric separation of weakly magnetic particles from non-magnetic particles takes place when the path traversed by the particles while in the separating field is made longer, and have devised apparatus by which the lengthening of the path is practically accomplished. This I do by providing a foraminous body of magnetically susceptible material, which moves through a magnetic field in a first direction, the magnetic field extending in a second direction, and feeding the particles to pass through the body and the field simultaneously in a third direction, the three directions being preferably orthogonal. The dimension of the body in the third direction is much greater than any heretofore used, so that the particles remain in the magnetic field for a longer interval, and there is more opportunity for magnetic particles to come into contact with the material of the body and hence to be delayed in passing through the body until it moves out of the field. Vibration is supplied, which not only promotes the passage of non-magnetic particles through the body while in the area of the field, but also promotes the release of magnetic particles after the body moves out of the field.

By making the motion of my foraminous body that of rotation about a horizontal axis, and performing the primary separation near the top of the rotation, I further avoid plugging of the body, as frequently occurs in other separators, because the vibration is continuously supplied and at the bottom of the rotation the body is in essence inverted so that any plugs are more readily released, together with the unseparated material held thereby, for subsequent recycling through the device.

When the material is supplied in slurry form, this arrangement makes possible the use of wash sprays to assist in removing separated material and to prevent by rinsing the continuance of stoppages to material movement.

Experiments have shown that apparatus embodying this invention is successful in producing a useful output of high grade concentrate when fed with trailings rejected in previous mining operations.

Various advantages and features of novelty which characterize my invention are pointed out with particularity in the claims annexed and forming a part hereof. However, for a better understanding of the invention, its advantages, and objects attained by its use, reference should be had to the drawing which forms a further part hereof, and to the accompanying descriptive matter, in which there is illustrated and described a preferred embodiment of the invention.

BRIEF DESCRIPTION OF THE DRAWING

In the drawing.

FIG. 2 is a side view of a separator according to my invention;

FIG. 4 is a fragmentary sectional view of the separator, along the line 4—4 of FIG. 3, to a larger scale;

FIG. 5 is a fragmentary sectional showing of a mounting ring;

FIGS. 6 and 7 schematically show the construction of a separator body section;

FIG. 8 is a fragmentary sectional view along the line 8—8 of FIG. 3, to a larger scale;

FIG. 9 shows schematically a magnetic structure used in the invention;

FIG. 10 is a flowsheet explaining the use of my new separator;

OPERATING PRINCIPLE OF THE INVENTION

While my invention is applicable to either wet separation or dry separation, I have chosen to illustrate the invention principally as embodied in a dry separator.

Figure 1:
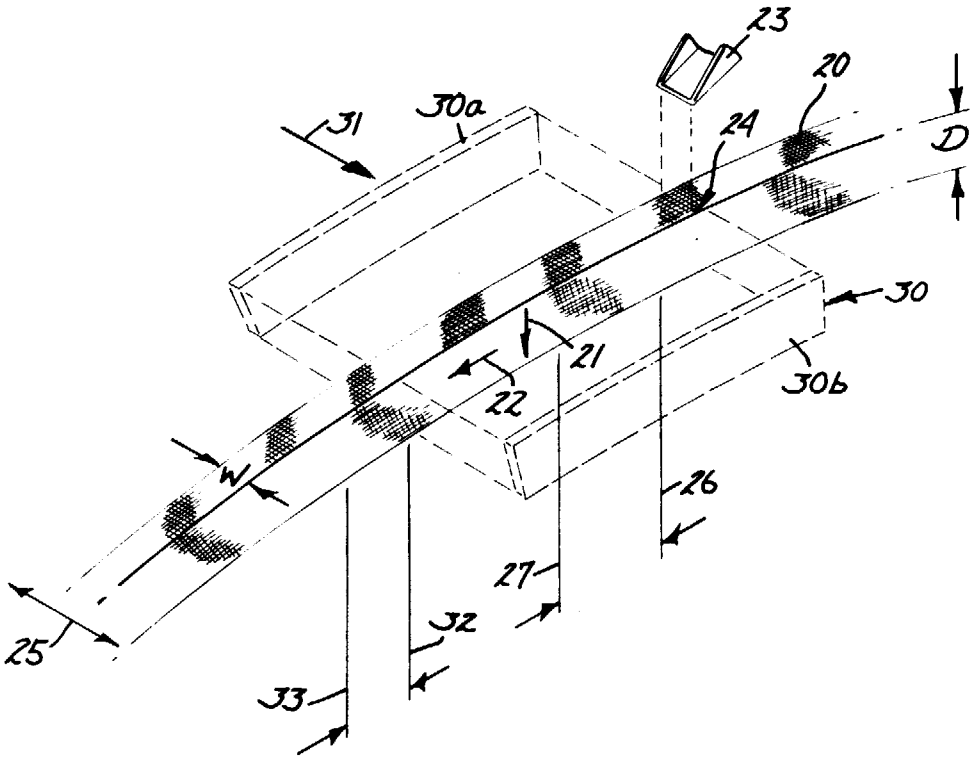
FIG. 1 is a schematic showing of the principle underlying the invention.

Referring now to FIG. 1, there is shown a body 20 of foraminous, magnetically susceptible material having a width "W" and a depth "O". By foraminous material is meant material of a porous or reticulate nature, in which the foramina are in communication to provide continuous, if tortuous, paths extending from surface to surface of the material in at least one direction, indicated by the arrow 21. Means are provided for causing movement of body 20 in the direction shown by the arrow 22, which is perferably orthogonal to the first direction.

The direction of motion of body 20 is generally horizontal. Means 23 are provided for feeding to the upper surface of body 20 at a location 24 a mixture of magnetic and non-magnetic particles of size suitable to follow the tortuous paths through the body and thus emerge at the lower surface. To promote the passage of particles through body 20, the latter is continuously subjected to vibration, by suitable means not shown in the figure, the direction of vibration being that shown by arrow 25. In the absence of any other factor, particles deposited on the upper surface of body 20 at location 23 emerge from the lower surface of the body after an interval during which the body has moved forward. The lengths of the paths followed by the various particles are not identical, and the rates of downward motion of the particles are not all the same, so that particles emerge from body 20 at locations falling between the lines 26 and 27.

Stationary with respect to body 20 is an arrangement 30 for establishing a unidirectional magnetic field extending in the direction of arrow 31, which is preferably orthogonal to the directions of arrows 21 and 22 previously defined. This arrangement is preferably in two parts 30*a* and 30*b*, positioned close to and on opposite sides of body 20, and may comprise either an array of permanent magnets or an electromagnetic surface, the former being preferable. The field is relatively intense and relatively concentrated, so that it can be said that each point of body 20 enters the field at a first location and leaves it at a second, these boundaries of the field being readily determinable.

It will be appreciated, since body 20 is of magnetically susceptible material, that when a portion of the body enters the magnetic field, a multitude of induced poles appear in the body along the tortuous paths therethrough, and that these poles attract and hold the magnetic particles which come sufficiently close to them, thus preventing their passing through the body for discharge within the normal discharge interval. It follows that, the depth (dimension D) of the body being sufficiently great, almost every magnetic particle comes close enough to an induced pole, to be held thereby, so that the passage of magnetic particles through the body is magnetically opposed. The extent of the field in the direction of movement of the body is greater than the range 26, 27 so that within that range emergent particles are almost entirely non-magnetic tailings.

As body 20 moves out of the magnetic field, the induced poles disappear, and the magnetic particles are no longer held to the body, but are free to find their way out through its bottom surface. They appear during a range of displacements falling between the lines 32 and 33, and their release is promoted by the continued vibration of the boby.

In practice, the operation of the device departs somewhat from the pure theory just described. When a magnetic particle is held in body 20, it may also prevent the passage of other, non-magnetic particles. The flow of non-magnetic particles may also be sufficient to carry away a magnetic particle from an attracted position to be again attracted further down in body 20, so that the density of magnetic particles may be greater near the lower surface of the body. It has been found most practical to dimension the body, and adjust its speed and the rate of feed so that the trailings discharged between lines 26 and 27 are substantially free from magnetic particles, acception a lower purity of "concentrate" deposited between locations 32 and 33 and recycling this material if necessary to improve its purity.

DESCRIPTION OF THE PREFERRED EMBODIMENTS

Figure 3:
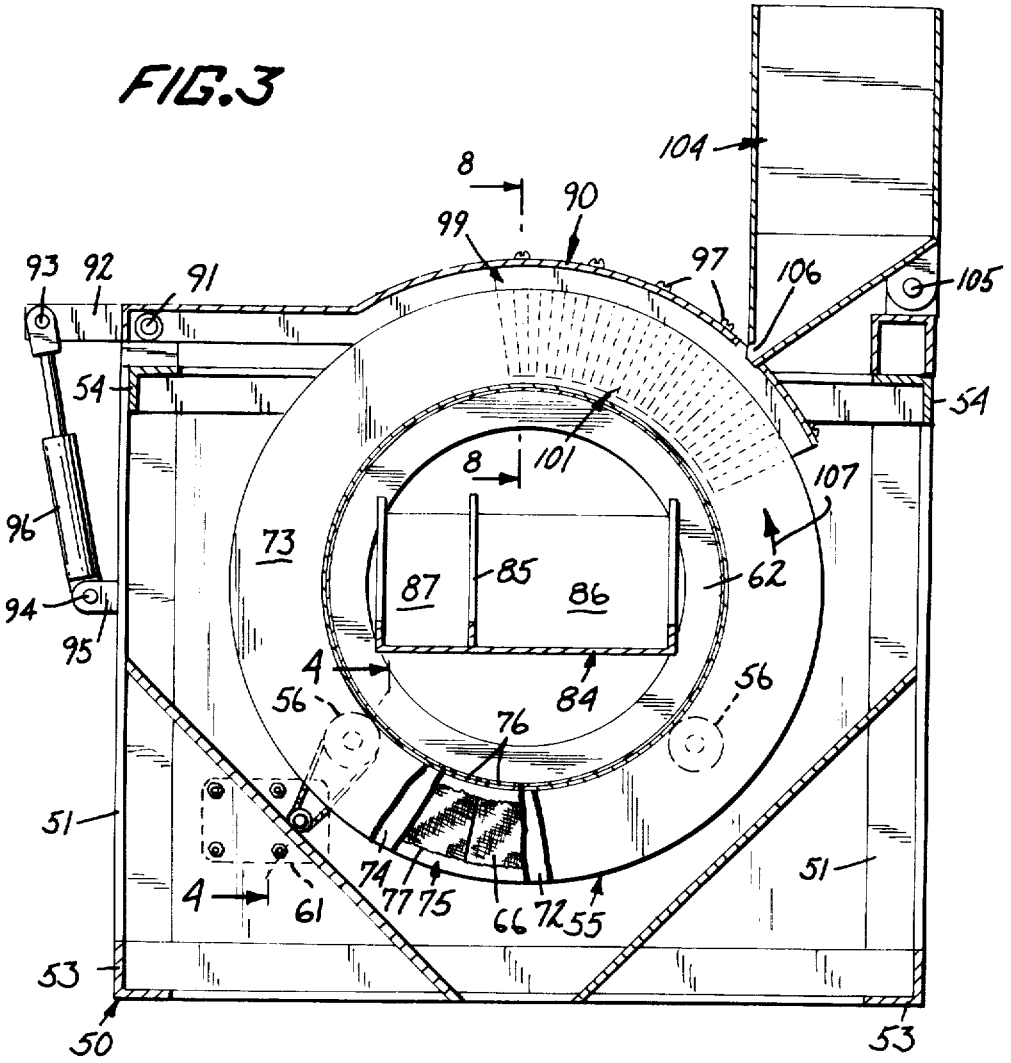
FIG. 3 is a transverse sectional view along the line 3—3 of FIG. 2 on a somewhat larger scale.

A practical embodiment of the invention for use with dry material is shown in FIGS. 2 and 3, details of construction being shown in FIGS. 4–9. A frame structure 50 is shown to comprise a pair of end members 51 and 52 interconnected by lower structure 53 and upper structure 54. A hollow cylinder 55 is mounted for rotation about a horizontal axis in frame structure 50, being gravitationally carried on a plurality of rollers 56 pivoted in end members 51 and 52. As shown in FIG. 4, one of the rollers 56, carried in a bearing 57 in end member 52, is arranged to be driven by a sprocket and chain connection 60 from a motor 61 also carried by end member 52, this in turn causing rotation of cylinder 55 about its axis. The cylinder is reinforced at its ends by internal flanged discs having central apertures such as disc 62.

A vibrator 63 is carried on a bracket 64 extending inwardly from end member 51, and continuously bears against disc 62 as it rotates, to maintain the cylinder in vibration: contact between the disc and the vibrator is by a suitable number of antifriction contact members 65. The vibration preferably has at least a principal component in the direction of the axis of the cylinder.

A number of separator elements 66 are mounted on the outside of cylinder 55 by specially formed mounting rings 67, shown in detail in FIG. 5 and made of aluminum or some other non-magnetic material. Each ring comprises a cylinder band 70 secured to the cylinder as by screws 71, and a pair of outwardly extending flat flanges 72 and 73, the former joining the band along one edge and the other extending from the band part way across its width. The space 74 between flanges 72 and 73 is provided for the passage of a magnet structure as will be described below. The separator elements 66 are contained in the spaces 75 between each flange 73 and the flange 72 of the mounting ring adjacent - to the left as seen in FIG. 5. Band 70 is pierced throughout its circumference by an array of apertures 76 which may conveniently be axially directed slots, and the surface of cylinder 55 underlying the intended locations of ring 67 is also perforated, to allow free passage of particulate material in space 75 through the ring and the drum.

Figure 7:
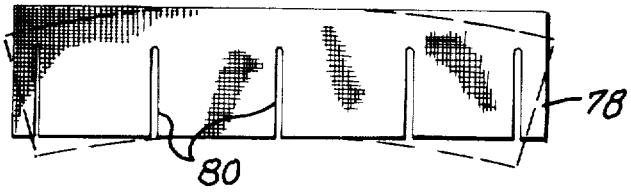

Each of separator elements 66 is constructed from a plurality of arcuate sections to comprise a hollow cylindrical body 77 the width of space 75, the radial thickness of the body being substantially the radial dimension of flanges 73. Each arcuate section 78 is made from standard carbon steel screening which is first folded upon itself as shown in FIG. 6 in a number of plys which when well compacted are of thickness to fit into space 75. The block of foraminous or reticulated material so formed is subjected to a series of transverse saw cuts 80 as shown in FIG. 7, permitting it to be bent into the desired form of a segment of a hollow cylinder, as shown in dotted lines in FIG. 7. Each separator body is made of a desired plurality of these sections in circumferential end-to-end relation: where the cylinder diameter is four feet, for example, fifteen was found to be a satisfactory number of sections. The sections may be held securely in place by a peripheral strapping 81 of the same screen material, clamped in any suitable fashion at its end as suggested at 82 in FIG. 8. Cylinder 55, rings 67, plus separator elements 66 comprise a separator drum 88.

The use of bodies 66 constructed as described results in a space traversed by a plurality of tortuous and branched passages through which particles may fall by gravity. Magnetic poles are induced in the screen material by reason of the strong magnetic fields of the magnet structure. The sizes of the particles are known, and the mesh dimensions and number of layers of the screen material are chosen with the particle size in mind, to give a great number of opportunities for each magnetic particle to reach a point where it contacts a south induced pole at one end and a north induced pole at the other, the optimum condition for retention of the particle if it is magnetic. Of course, smaller magnetic particles may be less securely held by contact at one point with an induced pole in the body.

A pair of troughs 83 and 84 are mounted in end members 51 and 52 to pass through the center of drum 88, and slope downwardly towards the ends of the drum. The troughs are provided with a laterally adjustable partition, as shown at 85 in FIG. 3. The portion of trough 84 to the right of partition 85 in FIG. 3 receives and discharges the tailings output of the separator, and will be referred to as the tailings short, while the portion 87 of the trough to the left of the partition receives and discharges the concentrate output of the separator and will be referred to as the concentrate chute.

A top 90 of transformer iron extends over the top and ends of frame 50. It is pivoted to end members 51, 52, as suggested at 91 in FIG. 3, and a pair of arms 92 extend rearwardly therefrom carrying pivot pins 93 near their extremities. A second set of pivot pins 94 are carried by lugs 95 projecting rearwardly from the end members. Connected pivotally between the set of pivot pins 94, 93, are a pair of hydraulic cylinders 96. When cylinders 96 are hydraulically energized, their lengths between pivot points is reduced, thus pivoting top 90 at 91 to give access to the upper surface of drum 88, and to components carried on top 90.

A portion 98 of top 90 is a cylinder coaxial with drum 88. Secured to the concave side of portion 98 by screws 97 are a plurality of non-magnetic ribs 100 which are generally Z-shaped in cross section and are curved to fit member 98. Secured to ribs 100 along the edge remote from member 90 is a magnetic structure 99 preferably comprising an array of permanent magnets 101, each having an internally threaded aperture 102 for securing the magnet to a member 100 by a screw 103. The magnets are arranged in flat sheets having two edges radial and two edges concentrically arcuate, and the magnetic axes are perpendicular to the sheet with the polarities the same throughout the array, as suggested in FIG. 9. Single magnetic slabs having the desired size and configuration would perhaps be ideal, but the field intensity desired is so high as to dictate barium ferrite for the magnetic material, and it is not economically available in such relatively large sizes.

Ribs 100 are so positioned along top portion 98 that the sheets of magnets enter the spaces between flanges 72 and 73 in rings 67, so that each body 66 is positioned between two magnetic sheets. This brings up the point that the widths of the bodies, dimension W of FIG. 1, are limited by the field strengths of magnets 101, since even the strongest available magnets are capable of maintaining the desired high magnetic fields over only limited air gaps. Thus, while additional body thickness can be obtained if desired by forming a second, outer body around a first, inner one, the widths of the bodies can only be increased to a certain maximum value.

As shown in FIG. 3, magnetic structure 99 interdigitates with the separator bodies on drum 88 for only a limited angular extent near the top of its rotation, say between 60 degrees and 75 degrees. It is within this angle that the principal separation between magnetic and non-magnetic particles takes place. The mixture is supplied to the separator through a hopper 104 pivoted to frame structure 50 at 105, see FIG. 3, so that it can be tilted back to permit the opening of top 90 when desired. Hopper 104 terminates at its lower, slanted portion in a row of individual feeder nozzles 106 generally like elements 25 of FIG. 1, which supply mixture to the upper surfaces of the various separator bodies 77 between the flanges 72 and 73, without allowing the mixture to enter the spaces passed through by the magnetic sheets. This factor is a first limitation on the rate of feed of material to the separator. A second limitation is that the feed cannot be greater than the amount of material which, if entirely non-magnetic, could flow through its tortuous passages in body 77 and emerge while within the field of a magnetic structure: this maximum must in practice be reduced as the proportion of magnetic material increases, since trapped magnetic material reduces the effective percent void ratio and, hence, the space for passage of non-magnetic material.

The direction of rotation of the drum is shown by the arrow 107, and the feed point must be displaced forwardly from the initial magnets to be sure that a minimum number of particles run backward along the separator bodies and fall untreated to the floor.

Theoretically, only non-magnetic particles fall into the tailings chute 86, see FIG. 3, and only magnetic particles fall into the concentrate chute 87: partition 85 is adjustable to improve this separation with variations in the richness of the material being fed to the separator. As a matter of fact, however, there is some tendency for the separator body paths to become plugged, so that material is carried past the point at which it can fall into the concentrate chutes 87. Such material is usually discharged 180 degrees later in the rotation of the drum, from the joint effect of gravity and of vibrator 63, and falls to the floor with perhaps a small amount of unsorted material falling directly from the input. While some valueless particulate matter may be found here, it is in general material which has never passed through the machine, and, hence, is appropriate to be returned to hopper 104. This material is given the name "middlings" for the purposes of this application.

Reference should now be made to FIG. 10, which is a flowsheet showing how the embodiment of my invention just described is to be used. It envisages the use of three such separators, or a triple pass of material through a single separator, the number of the machine of pass being indicated as by "Phase I", "Phase II", and so forth. At each phase of the operation there results tailings, concentrate, and middlings. In each case, the concentrate is suitable to be advanced to the next phase, and the middlings are suitable to be returned to the input of the same phase, either concurrently or serially. The tailings from Phase I are essentially worthless and may be discarded. The tailings of each phase subsequent to Phase I, while of less richness than the other two outputs, are nevertheless still worth recycling, and are returned to the input of the next previous phase, so that eventually all gangue appears as tailings I and all valuable particles appear as concentrate II, the output of this flowsheet. The number of stages may be increased to four or decreased by two, for example, at the judgment of the operator.

The operation of this embodiment of the invention through a single phase thereof, is as follows. It is assumed that the apparatus has been inspected and is known to be in good condition. Motor 61 is set in operation, causing rotation of drum 88, and vibrator 63 is set in operation, causing the drum to vibrate as well as to be rotated. The mixture of particles to be separated, having been reduced to a size appropriate to pass through the separator bodies, is supplied to hopper 104 and thereby through nozzles 106 to the outer surfaces of bodies 66. Under the influence of gravity and of vibrator 63 the particles begin to pass through the tortuous paths in the separator body, while being carried forward with the body in its rotation. Passage of magnetic particles is opposed magnetically by the poles in the body induced by the magnets 101, while non-magnetic particles not trapped behind such magnetic particles pass through the body and drop into tailings chute 86. As the body passes beyond the magnet structure, the magnetic particles are released, complete the path through the body, and drop, with any non-magnetic particles that have been trapped, and any other unduly delayed particles, into concentrate chute 87. The discharged particles pass by gravity down the chutes to suitable receptacles where they represent tailings 1 and concentrate 1.

As drum 88 continues to rotate, it reaches an attitude in which the tortuous passages are inverted, with respect to gravity, from their initial positions; any plugs which may have incipiently formed in the tortuous paths are now readily removed by vibration and gravity, releasing the trapped particles to fall on the floor under the separator as middlings I.

Tailings I is discarded. Middlings I is returned to hopper 104. Concentrate I is advanced to hopper 104 of the next separator and the flowsheet is continued.

At any appropriate maintenance interval, or if special need arises, the feed of mixed particles to hopper 104 may be interrupted, the hopper may be allowed to run empty and pivoted clockwise, in FIG. 3, out of the way, and hydraulic cylinders 96 may be energized to pivot top 90 counterclockwise about points 91 so that both the magnet structure and the drum may be inspected, the latter in operation if necessary.

There are a number of variables in addition to adjustment of partition 85 which one using my invention may wish to consider in adapting the apparatus for handling particulate materials of widely different characters. The magnetic structure may be varied both in configuration and in field strength. The speed of rotation of the drum and the size and spacing of the wires in the screen from which the separator bodies are made are also subject to variation. The rate, amplitude and direction of the applied vibration are also factors which can be varied. Finally, the depth of the separator bodies and the rate at which particulate material is fed to them may also be varied to affect the operation of the separator.

By way of illustration, certain specific parameters, which I have found preferable in at least one embodiment of my invention are as follows. A drum with a diameter of 36 inches and length of 4 inches has a separator body 1.25 inches wide and 4 inches deep. The body is formed of 30 layers of steel screen, the wire diameter being 0.015 inches and the wire spacing being 1/16 inch. The magnets, of barium ferrite having a pole strength of 3000 Gauss, are separated by a center distance of 4¼ inches along the axis of the drum: they ar 1 inch thick and extend along 62° of rotation of the drum, with no spacing between them angularly. Drum rotation is 4.3 rpm, material feed may be 26 lbs. per minute, and applied vibration, parallel to the axis, is at 60 Hz frequency with 1/64 inch double amplitude. The material fed is hematite and silica tailings, particle size about −28 + 325 mesh.

Figure 11:
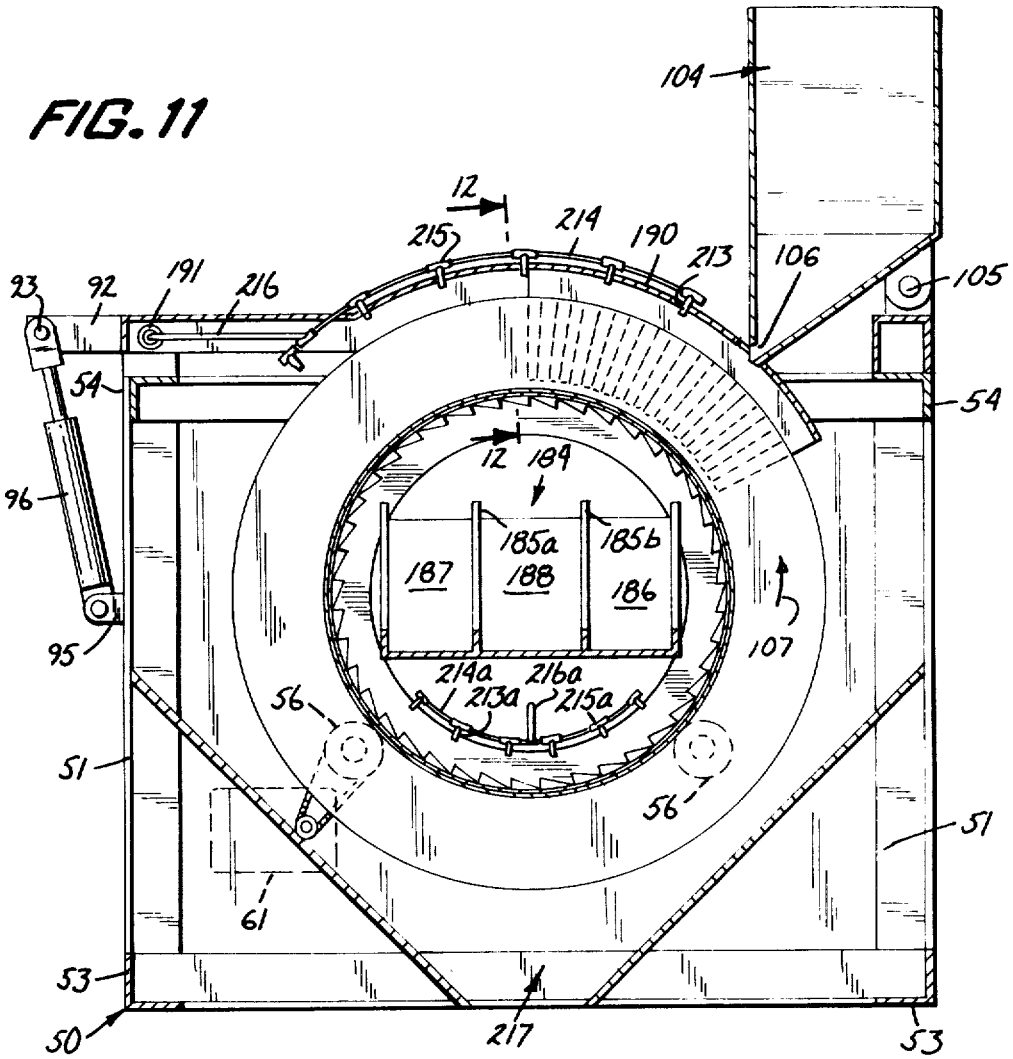
FIG. 11 is a view like FIG. 3 showing an arrangement especially adapted for use with material in slurry form.
Figure 12:
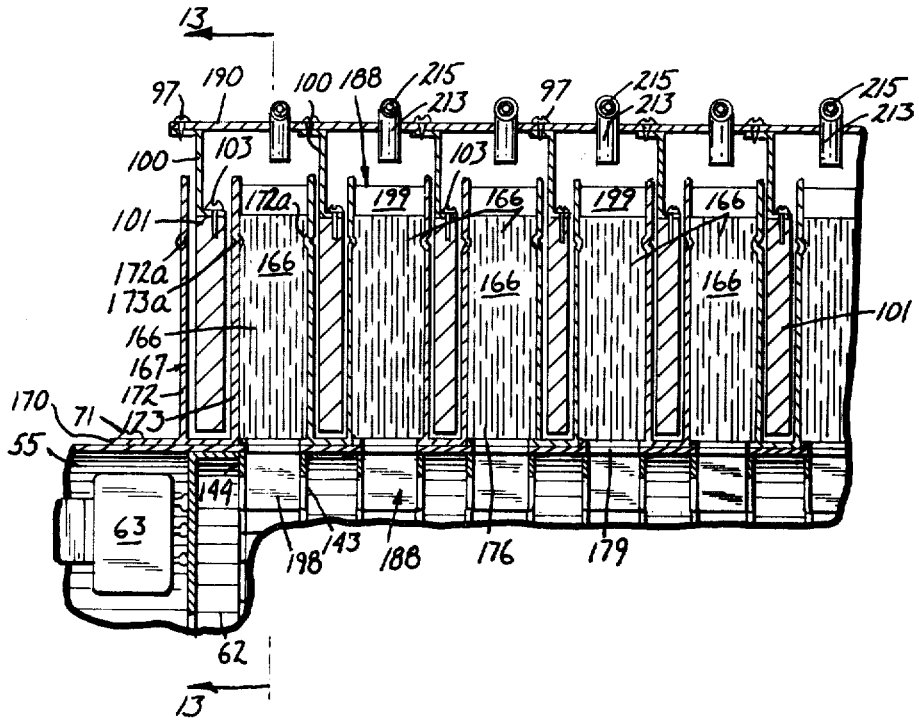
FIG. 12 is a fragmentary sectional view of the modified structure along the line 12—12 of FIG. 11.
Figure 13:
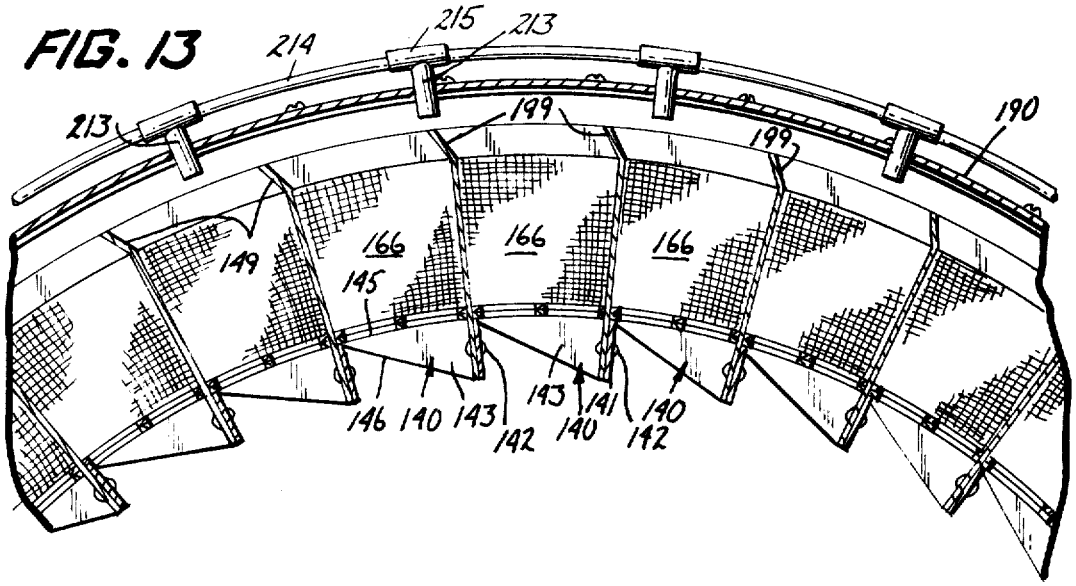
FIG. 13 is a fragmentary detailed view to a larger scale of the modification, parts being removed or broken away for clarity of illustration.

The structure just described can be used for materials either in the dry state or in water slurry. In the latter case, operation can be further enhanced by certain modifications shown in FIGS. 11–13. In these figures, parts which are the same as in previous figures are given the same reference numerals, and parts which are generally the same as those in the previous figures are given the same reference numerals increased by 100. The modifications are made to counteract the tendency for the water vehicle to wet the surfaces of the machine and then move along it by surface tension in directions other than that due to gravity: this results in an unintended and undesirable remixing of the separated components, and in dilution of separated components with raw input.

I have found that one helpful expedient is to compartmentalize the separation elements by radial water tight partitions, which prevent significant peripheral fluid flow. A second expedient is to provide washing sprays or nozzles by which clear water is supplied to augment the gravity flow to overcome the delay effect of surface tension forces in the separation elements, as well as assisting in the removal of stoppages.

One way of accomplishing this is shown. Drum 55 is as before. Separation elements 166 are of very limited angular extent. Each mounting 167 comprises a cylindrical band 170 secured to the drum as by screw 71, and a pair of outwardly extending flat flanges 172 and 173 having circumferential beads **172*a* and 173*a*. A plurality of partitions 188 are spaced around the drum, being secured to flanges 172 and 173 in any suitable fashion, such as radial grooves not shown. The partitions have tongues 198 extending inwardly through apertures 176 in rings 167 and aligned apertures 179 in drum 55, and may be held in place by notches in their edges which engage ribs 172*a* and 173*a*. Outwardly, the partitions are bent at about 45°, as at 199, in the direction of rotation of the drum. In this embodiment of the invention the separator elements 166 are maintained in position radially by ribs 172*a* and 173*a***.

Inside of cylinder 55 each tongue 198 carrys a specially shaped flow control member 140 having a radial wall 141, secured to tonge 198 by any suitable fastener 142, and a pair of sidewalls 143 and 144 extending therefrom in the direction of rotation of the drum and configured along first edges 145 to a water tight engagement with the cylinder inner surface. The other edges 146 are tapered toward the drum.

In this embodiment of the invention top 190, of magnetically susceptible material, supports, magnets 101 on ribs 100, and is provided with rows of perforations aligned axially with the positions of separation elements 166, each row comprising a set of apertures angularly spaced about the drum axis. A plurality of nozzles 213 extend through these apertures, and are connected to wash water manifolds 214 by suitable T-connections 215. As suggested in FIG. 11, manifolds 214 are supplied with wash water through a conduit 216 concentric with pivot 191. A second plurality of nozzles **213*a* at the bottom of cylinder 55 are fed from manifolds 214*a* to spray outwardly. Manifolds 214*a* are spaced axially along the drum, in alignment with the separator elements, and the nozzles are spaced arcuately along the manifold. Wash water is supplied to manifolds 214*a* through a conduit 216*a***.

The use of wash water makes desirable the division of troughs 183 and 184 into three portions or "launders" by partitions **185*a* and 185*b*. Launder 187 receives the concentrate which is usable as it is. Launder 186 receives the tailings, which are discarded. Launder 188 receives the middlings, which must be recirculated to improve the separation. The central portion of frame structure 50 at its bottom is also provided with a second middlings launder 217** for a reason presently to be described.

In this embodiment of the invention, hopper 104 may comprise a chute or flume to which independent nozzles 106 are connected. Suitable slurry transfer pumps of conventional nature may be provided for supplying the material to hopper 104, for carrying away tailings to discard and concentrates for disposition, and for recirculating middlings.

The operation of this embodiment of the invention is as follows. The drum motor 61 and vibrator 63 are set in operation, wash water is supplied to conduits 216 and 216*a*, and a slurry of material to be separated is fed by hopper 104 to nozzles 106, which direct it to the outer surfaces of separator elements 166 at an angular location generally 45 degrees ahead of the upward vertical. In theory, non-magnetic particles pass directly through separator elements, as in the previous embodiment of the invention, but in practice this motion is considerably impeded by the characteristics of water moving in restricted spaces. Slurry cannot be supplied in sufficinet quantity to act as a pressure head enforcing said flow through the elements because it would overflow into the adjacent magnet spaces. However, as each compartment leaves the feeding zone, it passes under successive wash nozzles which add clear water to accelerate the passage of the non-magnetic component and later the magnetic components, through the elements. I have found that while there is an initial tailings component and a final concentrate component as before, the separation is no longer so sharply demarcated. The use of an intermediate middlings launder makes it possible to so position partitions 185*a* and 185*b* that acceptably pure concentrate, and tailings wich can economically be discarded, are delivered at 187 and 186 respectively, only the material entering 188 requiring to be recirculated.

Just as in the earlier embodiment, stoppages of the separator elements can occur, creating a pool of unseparated material, usually with wash water above it. In this embodiment, the unseparated material is carried around and dumped at the bottom of the frame for recirculation from launder 217. In addition, the provision of nozzles 216*a* makes it possible to flush out residual material and hydraulically break up stoppages, so that the drum is in good condition to again receive slurry by the time it rotates to feeder nozzle 106.

Numerous characteristics and advantages of my invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

What is claimed is:

1. The method of separating magnetic particles from non-magnetic particles as components of a slurried mixture thereof which comprises steps of:

feeding the slurry to the outer surface of a hollow filter drum rotatable on a horizontal axis, for passage therethrough as a plurality of separate inwardly moving streams;

magnetically delaying the passage of magnetic particles through said filter to emerge from said filter at a different time from the nonmagnetic particles;

separately receiving the magnetic and nonmagnetic particles discharged inwardly of said drum;

and preventing said discharged material from flowing around the inside of said drum as the drum rotates.

2. A magnetic separator, wherein mixed magnetic and non-magnetic particles are supplied as a slurry to the outer surface of a hollow separator drum rotatable on a horizontal axis, for subjection to inward gravitational force and vibratile and magnetic force parallel to the drum axis so that magnetic particles emerge inwardly from said drum for collection at a different location in the rotation thereof from that of which non-magnetic particles emerge for collection, said separator comprising, in combination:

a hollow support cylinder having perforations positioned therearound in axially spaced rows extending perpendicularly to the axis of the cylinder;

means mounting said cylinder with its axis horizontal for rotation thereabout;

annular mounting flanges secured in substantially liquid tight relation to the outside of said cylinder between the rows of perforations therein;

angularly spaced partitions secured between said flanges, in substantially liquid tight relation to said flanges and said cylinder, to extend outwardly from said cylinder in planes passing through the axis thereof, whereby to define with said flanges independent, axially adjacent circular arrays of independent chambers;

a plurality of filter matrices formed of plural layers of magnetically susceptible screen material sized and shaped to be received in said chambers with said layers orthogonal to the axis of rotation of said cylinder;

means for supplying the slurry to be separated to the upper outer surface of said matrices at a first angular location around the cylinder, for gravitationally actuated passage therethrough and inward discharge through the perforations in said cylinder;

magnetic means of limited angular extent located around said cylinder between the rows of chambers for delaying the passage through said matrices of magnetic particles in said slurry, to substantially inhibit said passage of said magnetic particles during a predetermined angular portion of the rotation of said drum, while permitting passage of non-magnetic particles;

separate means positioned within said cylinder for receiving liquid-borne non-magnetic particles gravitationally discharged from different locations of said drum;

and flow control members extending said partitions inwardly of said cylinder to prevent peripheral flow, around the inner surface of said cylinder, of liquid discharged through the perforations.

3. The structure of claim 2 in which said mounting means include further flanges spaced from and aligned with said first flanges to define therewith annular passages for fixed permanent magnets poled parallel to the axis of said drum, and apposed surfaces of pairs of said flanges are peripherally ribbed to retain said matrices against outward displacement.

4. The structure of claim 2 in which said matrices are of magnetic stainless steel screening, the diameter of and distance between the component wires of the screen and the number of layers of screen are chosen in accordance with the fineness of the slurry particles to be separated.

5. The structure of claim 2 in which said matrices are of galvanized steel wire screen, the diameter of and the distance between the wires of the screen and the number of layers of screen are chosen in accordance with the fineness of the slurry particles to be separated.

6. The structure of claim 2, and means directing water against the outer surfaces of said matrices subsequent to the supplying of said slurry, to promote the passage of particles therethrough.

7. The structure of claim 2 in which said partitions have tongues which extend through the perforations in said cylinder to support said flow control means in liquid tight relation against the inner surface of said cylinder.

8. The structure of claim 2 including fixed means within said cylinder for directing water downwardly against said flow control members and the inner surfaces of said drum, and through said perforations, to release particles trapped within said matrices for discharge outwardly from the bottom of said drum.

* * * * *